United States Patent [19]

Rubin

[11] Patent Number: 4,526,701

[45] Date of Patent: Jul. 2, 1985

[54] DYE STABILIZED DETERGENT COMPOSITIONS

[75] Inventor: Fred K. Rubin, Leonia, N.J.

[73] Assignee: Lever Brothers Company, New York, N.Y.

[21] Appl. No.: 297,588

[22] Filed: Aug. 31, 1981

[51] Int. Cl.[3] ..... C11D 9/00

[52] U.S. Cl. ..... 252/113; 252/89.1; 252/173; 252/174.19; 252/174.25; 252/407; 252/541; 252/542; 252/558; 252/DIG. 14; 8/525; 8/599

[58] Field of Search ..... 252/DIG. 14, 173, 174.18, 252/174.19, 174.24, 401, 402, 403, 113; 8/525, 599, 904, 905, 906, 907, 908

[56] References Cited

U.S. PATENT DOCUMENTS

| | | | |
|---|---|---|---|
| 2,324,347 | 7/1943 | Andersen | 252/522 R |
| 2,324,348 | 7/1943 | Andersen | 252/367 |
| 3,503,753 | 3/1970 | Dahle | 426/268 |
| 3,883,299 | 5/1975 | Baumgarte et al. | 8/578 |
| 4,021,376 | 5/1977 | Lamberti | 252/542 |
| 4,049,467 | 9/1977 | Rubin | 252/135 |
| 4,077,911 | 3/1978 | Okumura et al. | 252/403 |
| 4,129,423 | 12/1978 | Rubin | 252/86 |
| 4,300,900 | 11/1981 | Putzar et al. | 8/599 |
| 4,318,818 | 3/1982 | Letton et al. | 252/173 |

FOREIGN PATENT DOCUMENTS

| | | |
|---|---|---|
| 2034562 | 1/1972 | Fed. Rep. of Germany . |
| 51-051479 | 5/1976 | Japan . |
| 0945333 | 12/1963 | United Kingdom . |
| 2010892 | 7/1979 | United Kingdom . |

OTHER PUBLICATIONS

Natural Food Colors, Effect of pH, Active Wavelength, and Antioxidants on the Light Stability of Water-soluble Reddish Food Colors, Journal: Aichi-Ken Shokuhin Kogyo Shikensho Nempo, 1973, vol. 14, pp. 1-7.

Japanese Abstract 7210399-R entitled "Dentifrice-Incorporating Copper Chlorophyll and Ascorbic Acid".

C.A. vol. 84:38451v.

C.A. vol. 85:7449s.

Schwartz & Perry's "Surface Active Agents and Detergents", vol. I & II, Interscience Publishers, Inc., NY 1958.

*Primary Examiner*—John E. Kittle

*Assistant Examiner*—Hoa Van Le

*Attorney, Agent, or Firm*—James J. Farrell

[57] ABSTRACT

This invention discloses a color stabilized aqueous detergent composition comprising in percent by weight of the composition (a) about 0.25% to about 95% surfactant; (b) about 0.0001% to about 0.5% dye; and (c) about 0.1% to about 5% polyhydroxy carboxylic acid or a salt thereof whereby color fading of said dye in said composition is substantially prevented.

8 Claims, No Drawings

DYE STABILIZED DETERGENT COMPOSITIONS

This invention relates generally to dye stabilizers and more particularly to polyhydroxy carboxylic acids or their salts which prevent fading of dyes or dyestuffs commonly present in detergent products.

Liquid household products such as hard surface cleaners, dishwasher rinse agents and others, customarily are colored to make them aesthetically more appealing. Selection of particular colors is supposed to be indicative of certain properties, such as strength, mildness and the like of the product. For this purpose, it is desirable to employ dyes which produce vivid, clean colors or shades in aqueous medium. Some of the brightest water-soluble colorants, particularly in the blue and green range, tend to gradually fade even when not exposed to light and turn colorless when incorporated in certain liquid detergent products, a characteristic which renders them unsuitable for many detergent product applications. While an exact mechanism of the color loss has not yet been elucidated, free radical reactions or oxidative processes are believed to be responsible for the destructive effect. Certain antioxidants prevent the color destruction, but not every antioxidant is suitable or desirable for a detergent product. We have discovered that polyhydroxy carboxylic acids or their salts prevent color destruction and, by virtue of their nontoxic properties, are well suited for incorporation in detergent products.

U.S. Pat. No. 2,324,347 reveals the use of ascorbic acid to arrest the deterioration of the fragrance and the development of undesirable odors, as well as to arrest the darkening in color that normally occurs upon exposure of perfume to air.

U.S. Pat. No. 2,324,348 reveals the use of ascorbic acid in the inhibition of undesirable odors and colors in perfumed soaps.

U.S. Pat. Nos. 4,049,467 and 4,129,423 pertain to the removal of mineralic stains of discolorations from household surfaces.

None of the above-mentioned patents are concerned with nor teach the prevention of dye destruction and color fading encountered in household liquid detergent preparations colored with synthetic organic dyes. The use of ascorbic acid in the prior art is certainly not predictive of the results obtained by the formulations of the instant disclosure. It is, therefore, an object of the present invention to substantially overcome the deficiencies of the prior art and to provide a method for stabilizing the original color of certain classes of dyes and dyestuffs when employed in liquid household products.

The attainment of these and other objects is achieved by this invention which includes a color stabilized aqueous detergent composition comprising in percent by weight of the composition: (a) about 0.25% to 95% surfactant; (b) about 0.0001% to 0.5% dye; and (c) about 0.1% to about 5% polyhydroxy carboxylic acid or a salt thereof whereby color fading of said dye in said composition is substantially prevented.

The surfactants that may be used in the practice of this invention belong to the class of soaps, nonionic, anionic and amphoteric surfactants. A detailed description of surface active agents and detergents is found in Schwartz & Perry's "Surface Active Agents and Detergents", Vol. I & II, Interscience Publishers Inc., New York (1958) and is incorporated herein by reference.

Among the nonionic surfact active agents which may be of use in the scouring compositions of the present invention there may be mentioned the condensation products of lower alkylene oxides, for example, ethylene oxide, with alkylphenols, fatty acids, fatty alcohols, and the like. Particularly satisfactory compositions may be prepared using a fatty acid alkanolamide, preferably a mono- or di-ethanolamide but other alkanolamides having similar properties such as the isopropanolamides, the glycerolamides and the tris(hydroxymethyl)-methylamides may also be effective. It is preferred to use a mono- or di-ethanolamide of a fatty acid having from 8 to 18 carbon atoms in the molecule, especially the mono- or di-ethanolamide of lauric acid or a mixture of acids rich in lauric acid such as may be obtained from oils such as palm kernel oil or coconut oil. Lauric diethanolamide has been found to be especially satisfactory. Where a large amount of nonionic surface active agent is employed some of it may be present as a dispersion in the liquid medium. This does not adversely affect the properties of the composition. Water-soluble amine oxides having one alkyl or hydroxy alkyl group of 8 to 20 carbon atoms preferably 12 to 14 carbon atoms and two alkyl groups having 1 to 3 carbon atoms may also be used as the nonionic component in the scouring composition.

Among nonionic surface active agents useful for rinse agent compositions are alkylphenol/ethylene oxide condensates, alcohol ethoxylates, polyoxyethylene/-polyoxypropylene block copolymers, oxypropylene-oxyethylene derivatives of ethylene diamine, polyfunctional polyoxyalkylene glycols and mixtures thereof.

Among various anionic synthetic detergents which may be used in the compositions of the present invention are: alkylaryl sulphonates, alkyl sulfates, alkyl ether sulfates, acylaminoalkane sulphonates and mixtures thereof. Generally about 0.25% to about 10% of the anionic surfactant is used.

Among amphoteric surfactants coco-amidobetaine is preferred in the range of about 0.5% to about 10% by weight of the composition.

Adjuvants and other ingredients include solubilizing or coupling agents, preservatives, sequestrants, perfumes, ammonia, germicides, anti-tarnishing agents and the like ranging from 0% to about 15% by weight of the composition.

Among coupling agents, alcohols, particularly polyhydric alcohols, such as propylene glycol are preferred.

Among sequestrants polyphosphate and citric acid are preferred.

Among preservatives 1,2-benzisothiazolin-3-one (Proxel CRL, ICI America) is preferred.

Among perfumes, any one which is commonly employed in detergent products and which are well known to the art, may be employed.

Anti-tarnishing agents may include lauroguanamine, α-benzoin oxime, mercapto benzothiazole and the like.

Among the colors of household cleaning products, shades of blue, green and aqua are most frequently used. Several of the most vivid shades in this class of dyes are represented by diamino derivatives of triphenyl methane characterized by the following formula:

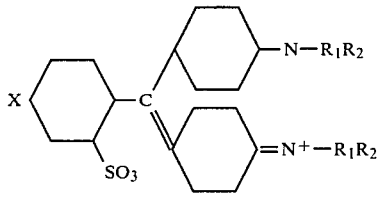

where $R_1=C_2H_5$ and $R_2=C_2H_5$ or

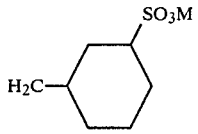

X=H, OH or $SO_3M$; and M=$Na^+$, $NH_4^+$, etc.

While the present invention was found to be operative with a number of triphenyl methane derivatives, it is not limited to this class of dyes only, but is applicable to other types of dyes, e.g. monoazo dyes such as certain FD&C Yellows exemplified by FD&C Yellow #5 (Color Index #19140).

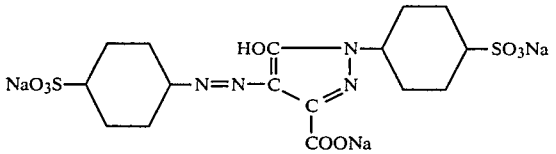

and FD&C Yellow #6 (Color Index #15985)

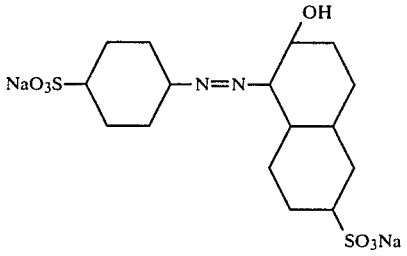

It should be noted that the color instability is not induced by exposure to light, but occurs in the dark as well. It is postulated that the dyes do not produce stable colors in household products probably due to oxidative effects.

It is known that the addition of certain reductants may prevent color fading in liquid detergent compositions. For instance, the addition of such reductants as hydroxylamine hydrochloride, butylhydroxy toluene, etc. will prevent the fading of colors in liquid detergent systems. However, some reductants, such as sodium hydrosulfite, may produce severe changes in the dye structure because of irreversible reduction resulting in rapid fading or discoloration, a situation which the reductant was intended to prevent. Accordingly, not every reductant is suitable for use in household products. Some reductants may be irritating and toxic while others may be destructive of the dyes.

We have discovered that certain polyhydroxy carboxylic acids and their salts effectively prevent color fading in liquid household products without the deficiencies associated with the use of other reducing agents. Without being bound to any particular theory, it is postulated that the dye stabilizing effect of the polyhydroxy acids or their salts is based on reduction rather than on other effects such as metal ion sequestration. For instance, sodium citrate is a good metal sequestrant at the pH range of the instant compositions but is ineffective as a dye stabilizer. Similarly, increase in ionic strength (addition of highly ionized salts such as potassium chloride) proved ineffective in dye stabilization.

The polyhydroxy carboxylic acids of the present invention have a common structural element, namely an olefinic bond with vicinal hydroxyl groups adjacent to a carboxyl group, viz:

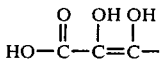

DETAILED DESCRIPTION OF THE INVENTION

Among various polyhydroxy carboxylic compounds, the following polyhydroxy carboxylic acids or their alkali metal salts have been found to be particularly useful:

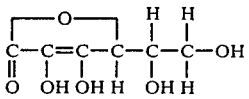

Ascorbic

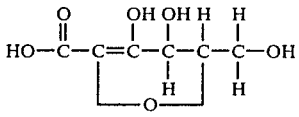

Erythorbic

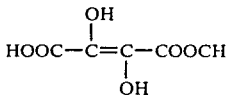

Dihydroxymaleic (= dihydroxyfumaric)

Representation of ascorbic and erythorbic acids as cyclic structure does not detract from the above disclosed presence of a common olefinic bond with vicinal hydroxyl groups. Upon dissolution in water, the ring opens and the full carboxyl or hydroxyl groups are restored.

While the free carboxylic acids adequately fulfill their function as dye stabilizers, it is preferred to add the alkali metal salts of the acids in alkaline media. The levels of acids, or their salts, range from about 0.1% to about 5.0% by weight of the total composition and preferably from about 0.4% to about 1.2%.

The liquid scouring compositions of the present invention also contain a solid phase comprising about 5 to about 65 percent by weight of said composition of a substantially water insoluble abrasive material selected from the group consisting of calcite, dolomite, feldspar, silica flour, quartz, pumice, polishing clays, perlite, diatomite, alumina and mixtures thereof.

The compositions, furthermore, may contain 0–10 percent by weight of a soap wherein said soap is an alkali metal salt of a 10 to 22 carbon fatty acid.

The compositions may further contain 0.25–15% by weight of a liquid-phase stabilizing electrolyte comprising alkali metal salts of phosphoric acid, sulfuric acid, carbonic acid and hydrohalogen acids. The salts of phosphoric acid may be present as polyphosphate complexes. Other suitable electrolytes are the alkali metal salts of water soluble carboxylic acids and the alkali metal and alkaline earth salts of synthetic builders such as ethylene diamine tetra acetic acid, carboxymethyloxysuccinate and carboxymethyloxytartronate. These electrolytes may also be mixed and employed as a mixture thereof.

The dyes in our compositions serve as signals and may be present at concentrations of about 0.0001–0.5% by weight. In liquid scouring compositions, the dye stabilizing effect is particularly noticeable with dyes derived from triphenylmethane, the formulae of such dyes having been shown supra.

It has also been discovered that a mixture of a triphenylmethane derived dye with a dye of the anthraquinone class tended to fade severely even though the anthraquinone dye did not fade by itself. The use of the polyhydroxy carboxylic acid salt according to the present invention substantially prevented the fading of such mixtures.

This invention is applicable to automatic dishwasher rinse agents as well. The rinse agents may contain water, a nonionic surfactant listed supra, a solubilizing or coupling agent such as propylene glycol or other alcohols and a sequestrant such as a polyphosphate or citric acid.

The examples on the following pages serve to further illustrate the invention without limiting the scope thereof.

The structural formulae of the dyes employed in the examples are shown below:

| C.I. Number | Structure |
|---|---|
| 15985 | 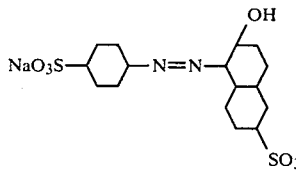 |
| 19140 | 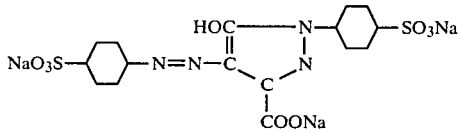 |
| 42045 | 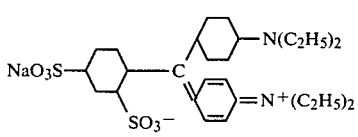 |
| 42053 | 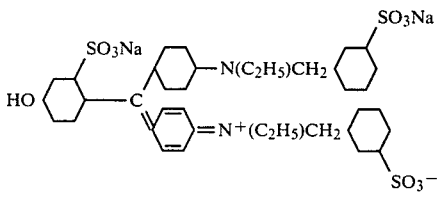 |

-continued

| C.I. Number | Structure |
|---|---|
| 42090 | 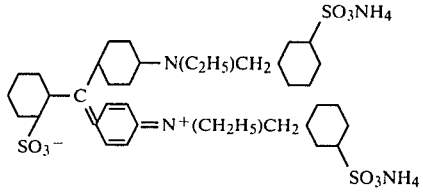 |
| 59040 | 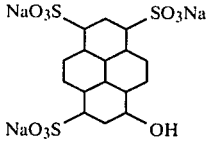 |

EXAMPLE I

The following compositions represent a blue colored liquid abrasive cleanser for cleaning pots, pans and kitchen surfaces. The compositions are identical except for the color stabilizer.

| | % by weight | | | |
|---|---|---|---|---|
| | A | B | C | D (Control) |
| Soap | 1.65 | 1.65 | 1.65 | 1.65 |
| Sodium alkylbenzene-sulfonate | 1.65 | 1.65 | 1.65 | 1.65 |
| Lauric/myristic diethanol-amide | 5.86 | 5.86 | 5.86 | 5.86 |
| Calcite abrasive | 10.0 | 10.0 | 10.0 | 10.0 |
| Sodium sulfate | 2.7 | 2.7 | 2.7 | 2.7 |
| Perfume | 0.3 | 0.3 | 0.3 | 0.3 |
| 1,2-benzisothiazolin-3-one | 0.003 | 0.003 | 0.003 | 0.003 |
| D&C Blue #4 (Color Index #42090) | 0.003 | 0.003 | 0.003 | 0.003 |
| Color stabilizer: | | | | |
| Sodium ascorbate | 0.6 | — | — | — |
| Sodium erythorbate | — | 0.6 | — | — |
| Dihydroxy maleic acid | — | — | 0.5 | — |
| Water balance to | 100.0 | 100.0 | 100.0 | 100.0 |

Composition D represents a control without color stabilizer. After a five month storage period (in light and dark) at ambient conditions, the control had become severely faded to the point of being colorless, while compositions A, B and C substantially retained their original blue color.

EXAMPLE II

The basic composition shown in Example I was colored aqua and stored with and without color stabilizer, viz:

| | % by weight | |
|---|---|---|
| | E | F (Control) |
| Soap | 1.65 | 1.65 |
| Sodium alkylbenzene sulfonate | 1.65 | 1.65 |
| Lauric/myristic diethanolamide | 5.86 | 5.86 |
| Calcite abrasive | 10.0 | 10.0 |
| Sodium sulfate | 2.7 | 2.7 |
| Perfume | 0.3 | 0.3 |
| FD&C Blue #1 (Color Index #42090) | 0.0007 | 0.0007 |
| D&C Green #8 (Color Index #59040) | 0.0004 | 0.0004 |
| Color stabilizer: Sodium | 0.5 | — |

-continued

| | % by weight | |
|---|---|---|
| | E | F (Control) |
| ascorbate | | |
| Water balance to | 100.0 | 100.0 |

After a five month storage period at ambient conditions, composition F (Control) had turned colorless while composition E substantially retained its original aqua color.

EXAMPLE III

The basic composition shown in Example I was colored a blue-green with 0.001% FD&C Green #3 (Color Index #42053). The color stabilizers were:

| | |
|---|---|
| Composition G | 0.6% sodium ascorbate, |
| H | 0.6% sodium erythorbate, |
| I | 0.5% dihydroxy maleic acid, |
| J | Control without color stabilizer. |

After a storage period of five months at ambient conditions, the control had become severely faded, the stabilized samples essentially retained their color although they were slightly duller than the original color. Sample I, with dihydroxy maleic acid as stabilizer, turned somewhat greener than the other stabilized samples.

EXAMPLE IV

The basic composition shown in Example I was colored a bright blue with a triphenyl methane dye not certified for food, drug or cosmetic use. The dye is represented by Color Index #42045 and is sold, among other names, as Alphazurine 2G. Its structure is as follows:

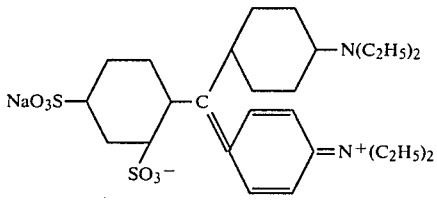

A color stabilizing composition (K) was prepared by adding 0.6% sodium ascorbate. This composition was stored in light and dark at ambient conditions, along with a control of same composition but without sodium ascorbate or other color stabilizer (Composition L). After a six week storage period, the control showed noticeable fading while the color stabilized composition K showed no fading. After a four month storage period, fading of the control had progressed further, while the color stabilized composition substantially retained its original strength and brightness. The difference between control and stabilized sample was more pronounced on light storage as opposed to dark storage.

EXAMPLE V

An aqua colored liquid scouring cleanser composition for cleaning hard surfaces such as in kitchen and bathroom was prepared as follows:

| | % by weight | | | |
|---|---|---|---|---|
| | M | N | O | P (Control) |
| Soap | 0.64 | 0.64 | 0.64 | 0.64 |
| Sodium alkylbenzene sulfonate | 2.00 | 2.00 | 2.00 | 2.00 |
| Lauric/myristic diethanolamide | 2.40 | 2.40 | 2.40 | 2.40 |
| Calcite abrasive | 48.0 | 48.0 | 48.0 | 48.0 |
| Clay | 0.5 | 0.5 | 0.5 | 0.5 |
| Sodium tripolyphosphate | 4.76 | 4.76 | 4.76 | 4.76 |
| Ammonia | 0.02 | 0.02 | 0.02 | 0.02 |
| Perfume | 0.3 | 0.3 | 0.3 | 0.3 |
| D&C Blue #4 (Color Index #42090) | 0.003 | 0.003 | 0.003 | 0.003 |
| Color stabilizer: | | | | |
| Sodium ascorbate | 0.6 | — | — | — |
| Sodium erythorbate | — | 0.6 | — | — |
| Dihydroxy maleic acid | — | — | 0.5 | — |
| Water balance to | 100.0 | 100.0 | 100.0 | 100.0 |

After a six month storage period at ambient conditions, in light and in the dark, composition P (Control) had faded appreciably while the color stabilized compositions showed only slight fading and some greening of the shade. Composition N, containing sodium erythorbate, showed the least greening.

EXAMPLE VI

The composition shown below represents a liquid rinse agent for automatic dishwashing.

| | % by weight | |
|---|---|---|
| | Q | R (Control) |
| Straight chain, primary ethoxylated alcohol with terminal block | 60.0 | 60.0 |
| Propylene glycol | 6.0 | 6.0 |
| FD&C Green #3 (Color Index #42053) | 0.0004 | 0.0004 |
| Color stabilizer: Sodium ascorbate | 1.0 | — |
| Water balance to | 100.0 | 100.0 |

After storage at ambient conditions for one year, the color stabilized composition remained a deep green; the control (Composition R) had turned completely colorless.

EXAMPLE VII

A composition identical to Example VI was colored yellow with 0.0004% FD&C Yellow #5 (Color Index #19140). Sodium ascorbate at 1.0% level was added as color stabilizer (Composition S). This composition was stored at ambient conditions alongside an identically colored control without color stabilizer (Compostion T). After one year, the control had completely faded showing no trace of color while the color stabilized sample substantially retained its original yellow color.

EXAMPLE VIII

A composition identical to the one in Example VI was colored an amber-yellow with 0.0004% FD&C Yellow #6 (Color Index #15985). Sodium ascorbate at 1% level was added as the color stabilizer (Composition U). This composition was stored at ambient conditions alongside an identically colored control without stabilizer (Composition V). After one year, the control had completely faded leaving no trace of color, while the color stabilized sample substantially retained its original amber color.

It is understood that the examples and embodiments described herein are for illustrative purposes only and that various modifications or changes in the light thereof will be suggested to persons skilled in the art and are to be included within the spirit and purview of this application and the scope of the appended claims. All percentages in these formulations and examples are by weight unless specified otherwise.

What is claimed is:

1. A color-stabilized aqueous detergent composition comprising in percent by weight of the composition:
   (a) about 0.25% to about 95% surfactant;
   (b) about 0.0001% to about 0.5% of dye selected from the group consisting of mono-azo, diamino derivatives of triphenyl methane, Color Index 59040 and mixtures thereof; and
   (c) about 0.4% to about 1.2% of a polyhydroxy carboxylic acid or a salt thereof wherein said acid is selected from the group consisting of ascorbic acid; erythorbic acid; dihydroxy maleic acid and mixtures thereof, whereby color fading of said dye in said composition is substantially prevented.

2. A color-stabilized automatic dishwashing rinse agent composition comprising in percent by weight of the composition:
   (a) about 2.5% to about 95% surfactant;
   (b) about 0.0001% to about 0.5% of dye selected from the group consisting of mono-azo, diamino derivatives of triphenyl methane, Color Index 59040 and mixtures thereof;
   (c) about 0.4% to about 1.2% of a polyhydroxy carboxylic acid or a salt thereof wherein said acid is selected from the group consisting of ascorbic acid; erythorbic acid; dihydroxy maleic acid and mixtures thereof, whereby color fading of said dye in said composition is substantially prevented;
   (d) 0% to about 15% other ingredients; and
   (e) water to make 100%.

3. A color-stabilized liquid scouring composition comprising in percent by weight of the composition:
   (a) about 0.25% to about 25% surfactant;
   (b) about 0.0001% to about 0.5% of dye selected from the group consisting of mono-azo, diamino derivatives of triphenyl methane, Color Index 59040 and mixtures thereof;
   (c) about 0.4% to about 1.2% of a polyhyroxy carboxylic acid or a salt thereof wherein said acid is selected from the group consisting of ascorbic acid; erythorbic acid; dihydroxy maleic acid and mixtures thereof, whereby color fading of said dye in said composition is substantially prevented.

4. A composition according to claims 1, 2 or 3 wherein said surfactant is selected from the group consisting of anionic surfactants, nonionic surfactants, amphoteric surfactants, soaps and mixtures thereof.

5. A composition according to claim 3 wherein said abrasive is selected from the group consisting of calcite, dolomite, feldspar, silica flour, quartz, pumice, polishing clays, perlite, diatomite, alumina and mixtures thereof.

6. A composition according to claim 3 wherein said electrolyte is selected from the group consisting of alkali metal salts of phosphoric acid, sulfuric acid, carbonic acid, hydrohalogen acids, water soluble salts of carboxylic acids, alkali metal salts of ethylene diamine tetraacetic acid, alkaline earth salts of ethylene diamine tetraacetic acid, carboxymethyloxysuccinate, carboxymethyloxytartronate and mixtures thereof.

7. A composition according to claims 2 or 3 wherein said other ingredient includes one or more of the following: perfumes, coupling agents, sequestrants, germicides, ammonia, preservatives, anti-tarnishing agents and mixtures thereof.

8. A composition according to claims 1, 2 or 3, said dye being one or more compounds with formulas corresponding to the formulas of Color Index Numbers selected from the group consisting of 15985, 19140, 42045, 42053, 42090, 59040 and mixtures thereof.

* * * * *